US007922637B2

(12) United States Patent
Motokawa et al.

(10) Patent No.: US 7,922,637 B2
(45) Date of Patent: Apr. 12, 2011

(54) CONDUCTIVE ROLLER

(75) Inventors: Shinji Motokawa, Yokohama (JP); Kenta Shikakura, Yokohama (JP)

(73) Assignee: Synztec Co., Ltd., Kanagawa (JP)

( * ) Notice: Subject to any disclaimer, the term of this patent is extended or adjusted under 35 U.S.C. 154(b) by 1141 days.

(21) Appl. No.: 11/644,906

(22) Filed: Dec. 26, 2006

(65) Prior Publication Data

US 2007/0149377 A1 Jun. 28, 2007

(30) Foreign Application Priority Data

Dec. 28, 2005 (JP) ..... 2005-380316
Dec. 20, 2006 (JP) ..... 2006-343519

(51) Int. Cl.
*B25F 5/02* (2006.01)

(52) U.S. Cl. ..... 492/56; 492/49; 492/28

(58) Field of Classification Search ..... 492/28, 492/30, 50, 52, 56
See application file for complete search history.

(56) References Cited

U.S. PATENT DOCUMENTS

| | | | | | |
|---|---|---|---|---|---|
| 3,936,170 | A * | 2/1976 | Shibano et al. | 399/154 |
| 4,807,341 | A * | 2/1989 | Nielsen et al. | 492/56 |
| 4,887,340 | A * | 12/1989 | Kato et al. | 492/53 |
| 5,057,871 | A * | 10/1991 | Hirose et al. | 399/283 |
| 5,102,741 | A * | 4/1992 | Miyabayashi | 428/447 |
| 5,471,285 | A | 11/1995 | Nagase et al. | |
| 5,659,854 | A * | 8/1997 | Masuda et al. | 399/176 |
| 5,733,235 | A | 3/1998 | Waku et al. | |
| 6,032,943 | A * | 3/2000 | Yabushita et al. | 271/109 |
| 6,400,919 | B1 | 6/2002 | Inoue et al. | |
| 6,534,180 | B2 * | 3/2003 | Hoshi | 428/413 |
| 6,558,781 | B1 | 5/2003 | Fuei et al. | |
| 6,660,399 | B1 * | 12/2003 | Kitano et al. | 428/500 |
| 7,638,196 | B2 | 12/2009 | Hirakawa et al. | |
| 2001/0055687 | A1 | 12/2001 | Hoshi | |
| 2003/0013588 | A1 * | 1/2003 | Hirayama | 492/56 |
| 2007/0104906 | A1 | 5/2007 | Hirakawa et al. | |
| 2007/0110936 | A1 | 5/2007 | Hirakawa et al. | |
| 2007/0149377 | A1 | 6/2007 | Motokawa et al. | |
| 2008/0247778 | A1 | 10/2008 | Motokawa et al. | |

FOREIGN PATENT DOCUMENTS

| | | | |
|---|---|---|---|
| JP | 04-214579 | A | 8/1992 |
| JP | 05-158341 | A | 6/1993 |
| JP | 05-281831 | A | 10/1993 |
| JP | 06-175470 | A | 6/1994 |
| JP | 2002-040760 | A | 2/2002 |
| JP | 3444391 | B2 | 6/2003 |
| JP | 2004-191659 | | 7/2004 |
| JP | 2004-191686 | | 7/2004 |
| JP | 2005-283913 | A | 10/2005 |
| JP | 2007-031703 | A | 2/2007 |

* cited by examiner

*Primary Examiner* — David P Bryant
*Assistant Examiner* — Jacob J Cigna
(74) *Attorney, Agent, or Firm* — Sughrue Mion, PLLC

(57) ABSTRACT

The present invention provides a conductive roller which has excellent resilience in response to deformation and exhibits small variation in electrical resistance. The conductive roller has a metallic core, a conductive elastic layer formed on the outer surface of the core to which layer conductivity has been imparted by carbon black, and a surface-treated layer formed through impregnating a surface of the conductive elastic layer with a surface-treatment liquid, wherein the difference ΔHs ($Hs_1$–$Hs_2$) between micro-hardness $Hs_1$ of a surface of the conductive roller and micro-hardness $Hs_2$ of the conductive elastic layer after removal of the surface-treated layer, the hardness being determined by means of a micro-hardness tester, is 5% or less of the micro-hardness $Hs_2$.

5 Claims, 2 Drawing Sheets

CONDUCTIVE ROLLER

The entire disclosure of Japanese Patent Applications Nos. 2005-380316 filed Dec. 28, 2005 and 2006-343519 filed Dec. 20, 2006 is expressly incorporated by reference herein.

BACKGROUND OF THE INVENTION

1. Field of the Invention

The present invention relates to a conductive roller (e.g., a charge-imparting roller, an image-transfer roller, or a development roller) for use in an image-forming apparatus such as an electrophotographic or toner-jet-type copying machine or printer. The roller of the invention is suitable for a transfer roller serving as an intermediate transfer member or a transfer member for use in a transfer-type image-forming apparatus such as a copying machine, a printer, or a facsimile machine.

2. Background Art

Conductive rubber rollers, which have rubber elasticity and controlled conductivity, are important members in an electrophotographic process. However, the molecule of the rubber for constituting a rubber roller generally does not have resistivity required for the process ($10^4$ to $10^9$ Ωcm), and such rubber roller employed in practice is formed from a limited rubber species such as epichlorohydrin rubber. In many cases, in order to ensure required levels of elastic modulus, mechanical strength, and temperature/moisture characteristics, electrical conductivity is imparted to a chemically stable rubber substrate such as silicone rubber, Ethylene-propylene rubber (EPDM), or polyurethane through addition thereto of conductive microparticles such as carbon black, and resistance of the roller is adjusted by forming a coating layer on the roller.

In recent years, the melting point of a toner binder for use in an electrophotographic copying machine has become lower and lower. In response to this trend, a development roller is required to have low hardness so as to provide a sufficient nip to ensure charging of the toner. Japanese Patent application Laid-Open (kokai) No. 2005-283913 discloses a development roller for satisfying the above requirement. The proposed roller, which includes an elastic layer, a urethane resin coating layer, and a thin layer formed of a hardened isocyanate, maintains softness over the entirety of the roller and has a hard surface.

Formation of a coating layer is not preferred, in that cumbersome steps are required, thereby increasing production cost. In an attempt to readily solve the problem, Japanese Patent application Laid-Open (kokai) No. 5-158341 discloses an approach including chemically treating a roller surface. Although the chemical treatment is an effective approach, a surface-treated conductive roller tends to have a hard surface. In practical use of a hardness-reduced roller, the surface of the roller is considerably deformed. Therefore, such a roller is required to have resilience in response to deformation. A roller having a hard surface-treated layer has insufficient resilience in response to deformation, and electrical resistance varies during use thereof, which is problematic.

SUMMARY OF THE INVENTION

Under such circumstances, an object of the present invention is to provide a conductive roller, which has excellent resilience in response to deformation and exhibits small variation in electrical resistance.

In a first mode of the present invention for solving the aforementioned problems, there is provided a conductive roller having a conductive elastic layer to which conductivity has been imparted by carbon black, and a surface-treated layer formed through impregnating a surface of the conductive elastic layer with a surface-treatment liquid, wherein the difference ΔHs ($Hs_1-Hs_2$) between micro-hardness $Hs_1$ of a surface of the conductive roller and micro-hardness $Hs_2$ of the conductive elastic layer after removal of the surface-treated layer, the hardness being determined by means of a micro-hardness tester, is 5% or less of the micro-hardness $HS_2$.

A second mode of the invention is a specific embodiment of the conductive roller of the first mode, wherein an absolute value $|\Delta\mu|$ of the difference ($\Delta\mu=\mu_1-\mu_2$) between friction coefficient $\mu_1$ of the surface of the conductive roller and friction coefficient $\mu_2$ Of the conductive elastic layer after removal of the surface-treated layer is 30% or less of the friction coefficient $\mu_2$.

According the present invention, a conductive roller which has excellent resilience in response to deformation and exhibits small variation in electrical resistance can be provided.

DETAILED DESCRIPTION OF PREFERRED EMBODIMENTS

Figure 1:
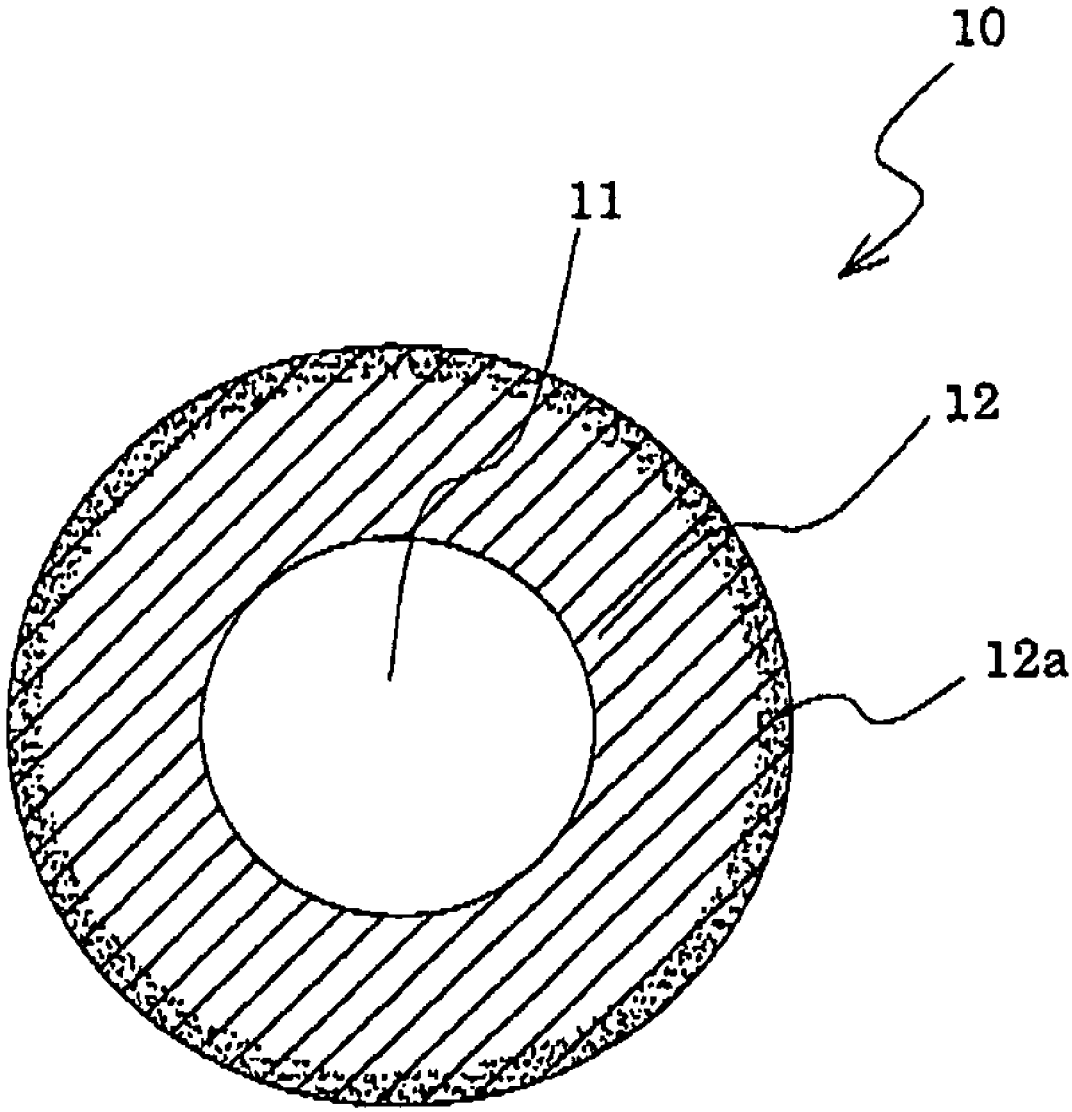
FIG. 1 schematically shows the conductive roller of the present invention.

The present invention has been accomplished on the basis of the finding that among conductive rollers each having a conductive elastic layer to which conductivity has been imparted by carbon black, and a surface-treated layer formed through impregnating a surface of the conductive elastic layer with a surface-treatment liquid, a conductive roller exhibiting a small increase in hardness, in the case where the surface-treated layer is formed on the surface of the conductive elastic layer, has resilience in response to deformation and exhibits small variation in electrical resistance.

The conductive roller of the present invention has a conductive elastic layer to which conductivity has been imparted by carbon black, and a surface-treated layer formed through impregnating a surface of the conductive elastic layer with a surface-treatment liquid, wherein the difference ΔHs ($Hs_1-Hs_2$) between micro-hardness $Hs_1$ of a surface of the conductive roller and micro-hardness $Hs_2$ of the conductive elastic layer after removal of the surface-treated layer, the hardness being determined by means of a micro-hardness tester, is 5% or less of the micro-hardness $Hs_2$. In the conductive roller of the present invention, the surface-treated layer can be readily formed through, for example, immersing a conductive elastic layer in a surface-treatment liquid. Therefore, the conductive roller can be produced at lower cost in a smaller number of steps, as compared with a conventional production method including providing a coating layer. In addition, the conductive roller of the invention differs from a conventional conductive roller having a surface-treated layer, which roller has a large difference in hardness between the surface of the surface-treated layer of the conductive roller and the inside of the conductive elastic layer. More specifically, the conductive roller of the present invention has a surface-treated layer having a relatively small thickness, and exhibits a small difference in hardness between the conductive roller surface and the conductive elastic layer after removal of the surface-treated layer. That is, the conductive roller has virtually uniform hardness from the conductive roller surface to the inside of the conductive roller. According to the conductive roller of the invention, surface hardness of the entirety of the conductive roller having a surface-treated layer can be reduced without considerably reducing the hardness of the conductive elastic layer. When used in a test apparatus or an actual apparatus, the conductive roller exhibits resilience in response to increased deformation of the conductive roller surface. In addition, the conductive roller exhibits small variation in electrical resistance after use for a long period of time.

In the present invention, the difference $\Delta Hs$ ($Hs_1-Hs_2$) between micro-hardness $Hs_1$ of a surface of the conductive roller and micro-hardness $Hs_2$ of the conductive elastic layer after removal of the surface-treated layer is defined, since the untreated state (before surface treatment) of the conductive elastic layer is equivalent to the state of the conductive roller after removal of the surface-treated layer. That is, the "conductive elastic layer after removal of the surface-treated layer" means a conductive elastic layer exposed through polishing out the surface-treated layer from the conductive roller. The state of the conductive elastic layer is almost equivalent to the untreated (before treatment) conductive elastic layer.

FIG. 1 is a cross-section of the conductive roller of the present invention. As shown in FIG. 1, a conductive roller 10 has a metallic core 11, and a conductive elastic layer 12 to which electrical conductivity has been imparted by carbon black. On the surface of the conductive elastic layer 12, a surface-treated layer 12*a* is provided. The surface-treated layer 12*a* is integrally formed with the conductive roller through impregnation of the surface of the conductive elastic layer 12 with a surface-treatment liquid and hardening the liquid.

The conductive elastic layer employed in the present invention has been imparted with electrical conductivity by use of carbon black. Among a variety of carbon black products having different properties, carbon micropowder is preferably employed. The amount of carbon for imparting conductivity to the elastic layer is preferably 2.5 mass % to 8 mass % with respect to the rubber material, more preferably 2.5 mass % to 5 mass %. Through controlling the amount of carbon, the rubber material exhibits a compressive permanent strain of 1% or less while maintaining electrical conductivity imparted by carbon. Hitherto, such a rubber material has not been obtained. In addition to an excellent compressive permanent strain, the rubber material relaxes the strain. Thus, the material is suited for members which are required to exhibit quick start-up performance.

When carbon is dispersed at a considerably high degree, electrical conductivity tends to decrease. In such a case, carbon may be added in an amount of about 8 mass %. When carbon is highly dispersed, increase in compressive permanent strain is prevented. In the case where a large amount of carbon is added to a rubber material, a carbon product which does not impair compressive permanent strain; for example, a carbon product which exhibits low oil absorption, which has large particle size, or which prevents formation of a mass structure in the material, is preferably used.

No particular limitation is imposed on the rubber material for use in the conductive elastic layer, and the layer can be formed from any conventionally employed rubber materials. Examples of the rubber material include ethylene-propylene rubber (EPDM), nitrile rubber, epichlorohydrin rubber, chloroprene rubber, and polyurethane. Of these, polyurethane is preferably employed.

When the polyurethane is employed as the rubber material for use in the conductive elastic layer of the present invention, the polyurethane is preferably formed of a polyurethane predominantly formed from a polyether-polyol, particularly preferably a thermosetting polyurethane which is produced through reaction between a polyether-polyol having an average number of functional groups contained in a single molecule thereof of 2.5 or more and a polyisocyanate having an average number of the functional groups contained in a single molecule thereof of more than 2, at an NCO/OH ration by mole less than 1. Since the polyurethane serving a rubber material has the aforementioned specific molecular structure, the matrix exhibits a hardness (JIS A) as low as about 60° and virtually no compressive permanent strain. The polyurethane is hardened while carbon is dispersed in the matrix.

The ether-based polyurethane, which is particularly preferably employed in the conductive elastic layer of the present invention, is a so-called castable polyurethane which can be produced through reaction between a polyisocyanate and a polyol predominantly containing an ether-based polyol. The thus-formed polyurethane exhibits small compressive permanent strain. In contrast, a similar ether-based polyurethane of a millable type, compressive permanent strain cannot be reduced sufficiently. An ester-based polyurethane is highly susceptible to hydrolysis, and thus cannot be reliably used for a long period of time.

When the polyurethane is employed as the rubber material for use in the conductive elastic layer of the present invention, the isocyanate which is reacted with the polyol may be, for example, a monomeric tri-functional isocyanate such as triphenylmethane triisocyanate, tris(isocyanatophenyl) thiophosphate, or bicycloheptane triisocyanate; or a mixture such as a nurate-modified polyisocyanate of hexamethylene diisocyanate (trimer and tri-functional, and pentamer and tetra-functional) or a polymeric MDI. A mixture of the aforementioned polyisocyanate having ≧3 functionalities and a typical bi-functional isocyanate compound may also be used. Examples of the bi-functional isocyanate include 2,4-tolylene diisocyanate (TDI), 4,4'-diphenylmethane diisocyanate (MDI), p-phenylene diisocyanate (PPDI), 1,5-naphthalene diisocyanate (NDI), 3,3-dimethyldiphenyl-4,4'-diisocyanate (TODI), modified prepolymers having these diisocyates at both ends, and oligomers thereof.

The conductive elastic layer employed in the present invention is formed by adding carbon black to the aforementioned rubber material and heating to harden the rubber material while the carbon dispersion state is maintained. Through the procedure, carbon black having a resistivity of about 0.1 to about 10 Ωcm can be dispersed in an elastomer (i.e., insulator) having a resistivity of $10^{12}$ to $10^{16}$ Ωcm, whereby the resistivity can be adjusted to $10^4$ to $10^8$ Ωcm (intermediate resistivity range).

The surface-treated layer of the present invention is formed by impregnating the surface of the conductive elastic layer with a surface-treatment liquid. The surface-treated layer is formed such that the difference $\Delta Hs$ ($Hs_1-Hs_2$) between micro-hardness $Hs_1$ of a surface of the conductive roller and micro-hardness $Hs_2$ of the conductive elastic layer after removal of the surface-treated layer is adjusted to 5% or less of the micro-hardness $Hs_2$. Through controlling the difference in hardness to fall within the above range, the conductive roller of the present invention has virtually uniform hardness from the surface to the inside of the conductive roller, thereby providing resilience in response to deformation.

The surface-treated layer of the present invention has a relatively thin surface; i.e., the impregnation depth from the surface is about 0.3 mm. By virtue of the small thickness of the layer, the difference $\Delta Hs$ ($Hs_1-Hs_2$) between micro-hardness $Hs_1$ of a surface of the conductive roller and micro-hardness $HS_2$ of the conductive elastic layer decreases, thereby reducing variation in electrical resistance.

In the present invention, the surface-treated layer satisfying the aforementioned requirements is formed by use of a surface-treatment liquid which has some degree of difficulty in permeating into the conductive elastic layer. The surface-treatment liquid employed in the present invention is essentially a mixture of an organic solvent and at least an isocyanate component dissolved therein. Through modification of the type of the isocyanate component and the organic solvent, the amount thereof, treatment conditions, etc., a surface-treatment liquid which cannot readily permeate into the conductive elastic layer is obtained. Specific approaches for obtaining such a surface-treatment liquid include use of an organic solvent which cannot readily permeate the conductive elastic layer, increasing the molecular weight of the isocyanate component, and shortening treatment time.

Examples of the organic solvent which is difficult to permeate into the conductive elastic layer include butyl acetate, pentyl acetate, N-pyrrolidone, and dimethyl sulfoxide. When such an organic solvent is employed, an isocyanate compound such as 2,4-tolylene diisocyanate (TDI), 4,4'-diphenylmethane diisocyanate (MDI), p-phenylene diisocyanate (PPDI), 1,5-naphthalene diisocyanate (NDI), or 3,3-dimethyldiphenyl-4,4'-diisocyanate (TODI); or a modified product or oligomers thereof may be employed. In the surface treatment, when the time for immersing the conductive elastic layer in a surface-treatment liquid is appropriately shortened, impregnation of the conductive elastic layer with the surface-treatment liquid is prevented, to thereby limit the permeation to the inside of the layer.

Examples of the isocyanate component having a large molecular weight include an isocyanate-end prepolymer having a number average molecular weight (Mn) of 500 to 5,000. The prepolymer preferably has a number average molecular weight of 1,000 to 2,500, more preferably about 2,000. Having a flexible molecular structure, such an isocyanate-end prepolymer prevents formation of resin and insulation in a portion from the inside of the conductive elastic layer to the roller surface, which would otherwise occur during formation of a surface-treated layer through a conventional technique. Thus, carbon black is present in a conductive layer stably, thereby preventing increase in electrical resistance. An isocyanate-end prepolymer having a number average molecular weight (Mn) of more than 5,000 is not preferably employed in a surface-treatment liquid, since the surface-treatment liquid hardly permeate into the conductive elastic layer and thus the surface-treated layer cannot effectively be formed. Notably, the isocyanate-end prepolymer is a urethane prepolymer which is produced through reaction between polyisocyanate and polyol and which has an end isocyanate group.

Examples of the isocyanate-end prepolymer include adducts each formed through addition, to an urethane compound, of an isocyanate such as 2,4-tolylene diisocyanate (TDI), 4,4'-diphenylmethane diisocyanate (MDI), p-phenylene diisocyanate (PPDI), 1,5-naphthalene diisocyanate (NDI), or 3,3-dimethyldiphenyl-4,4'-diisocyanate (TODI). Examples of the polyol component of the urethane compound include polyether polyol, polyester polyol, polycarbonate polyol, and polyolefin polyol.

No particular limitation is imposed on the type of organic solvent when the isocyanate prepolymer is employed, and organic solvents such as ethyl acetate, methyl ethyl ketone (MEK), and toluene may be employed. Needless to say, a solvent which is difficult to permeate into the conductive elastic layer may also be used.

The surface-treated layer of the present invention is formed predominantly from an isocyanate component through hardening and integerally with the conductive elastic layer such that the density of the isocyanate component gradually decreases from the surface to the inside of the conductive roller. Thus, bleeding of possible contaminants such as a plasticizer to the surface of the conductive roller can be prevented, to thereby provide a conductive roller having a highly anti-staining surface. Since the surface-treated layer is provided such that the density decreases from the conductive roller surface to the inside, electrical resistance of the layer is also graded from the surface to the inside.

So long as the effects of the invention are not impaired, the surface-treatment liquid may further contain a polyether polymer. Preferably, the polyether polymer is soluble in organic solvent and has an active hydrogen atom, which can be reacted and chemically bonded to an isocyanate compound. Examples of preferred polyether polymers having an active hydrogen atom include polymers having a hydroxyl group or an allyl group; e.g., polyol to use for an isocyanate-end prepolymer and glycols. Such a polyether polymer preferably has an active-hydrogen-containing group at one end of the polymer chain, as compared with a similar polymer having an active-hydrogen-containing group at each end of the polymer chain. The polyether polymer has a number average molecular weight of 2,500, preferably 300 to 1,000 in that the polymer imparts the surface-treated layer with elasticity.

Examples of the polyether polymer include polyalkylene glycol monomethyl ether, polyalkylene glycol dimethyl ether, allylated polyether, polyalkylene glycol diol, and polyalkylene glycol triol.

Through incorporation of the polyether polymer into the surface-treatment liquid, softness and strength of the layer formed through the treatment are enhanced, thereby preventing wear of the conductive roller surface and damage of a surface of a photoreceptor which abuts the conductive roller.

The surface-treatment liquid may further contain a polymer selected from among fluoroacrylic polymers and acrylic silicone polymers, so long as the effects of the present invention are not impaired.

The fluoroacrylic polymer and acrylic silicone polymer which are employed in the surface-treatment liquid of the present invention are soluble in a predetermined solvent and are reacted and chemically bonded to an isocyanate compound. The fluoroacrylic polymer is a solvent-soluble fluorine-containing polymer having, for example, a hydroxyl, alkyl, or carboxyl group. Specific examples include acrylate ester-fluoroalkyl acrylate block copolymers and derivatives thereof. The acrylic silicone polymer is a solvent-soluble silicone polymer, and specific examples include acrylate ester-siloxane acrylate block copolymers and derivatives thereof.

The surface-treatment liquid may further contain carbon black such as acetylene black serving as a conductivity-imparting material, so long as the effects of the present invention are not impaired.

Preferably, the surface-treatment liquid contains carbon black in an amount of 0 to 40 mass % with respect to the isocyanate component. An excessive amount of carbon black is not preferred, since problems such as release of carbon black from the roller and impairment in physical properties of the roller occur.

Preferably, the surface-treatment liquid contains a polyether polymer and/or fluoroacrylic polymer and/or acrylic silicone polymer in a total amount of 10 to 70 mass % with respect to the isocyanate component. When the total amount is less than 10 mass %, carbon black and similar substances cannot effectively be retained in the surface-treated layer, whereas when the amount is in excess of 70 mass %, electrical resistance of the charge-imparting roller increases, thereby impairing electric discharge characteristics, and the surface-treated layer cannot effectively be formed due to a relatively reduced amount of isocyanate.

The organic solvent employed in the surface-treatment liquid can dissolve the isocyanate component and the optionally added polyether polymer, fluoroacrylic polymer and acrylic silicone polymer.

The surface-treated layer can be formed through immersing the conductive elastic layer in the surface-treatment liquid or spraying the surface-treatment liquid onto the conductive elastic layer, followed by drying and curing, so as to impregnate the surface of the conductive elastic layer with the surface-treatment solution.

Currently employed conductive rollers generally exhibit variation in electrical resistance when employed in an actual machine. However, the conductive roller of the present invention, having a thin surface-treated layer as mentioned above, exhibits remarkably small variation in electrical resistance after employment thereof in an actual machine. Thus, even when the conductive roller of the present invention is continuously employed as a development roller in an-actual machine, consistent image quality can be maintained regardless of the number of sheets passed through the roller.

The conductive elastic layer employed in the present invention preferably has a micro-hardness $Hs_2$ of 30° to 70°, more preferably 50° to 60°.

When the hardness of the surface of the conductive roller of the invention having the surface-treated layer on the conductive elastic layer is measured by means of a micro-hardness tester, the difference $\Delta Hs$ ($Hs_1-Hs_2$) between micro-hardness $Hs_1$ of a surface of the conductive roller and micro-hardness $Hs_2$ of the conductive elastic layer after removal of the surface-treated layer is 5% or less of the micro-hardness $Hs_2$. In other words, since such a thin surface-treated layer can be formed by use of the aforementioned surface-treatment liquid, micro-hardness $Hs_1$ of the conductive roller surface and that of the conductive elastic layer ($Hs_2$) are virtually equal to each other. Therefore, a roller of interest can be produced through adjusting the micro-hardness $Hs_2$ of the conductive elastic layer to a predetermined value with respect to a desired value of the micro-hardness $Hs_1$ of the conductive roller surface. The conductive roller of the present invention, in which the conductive elastic layer and the conductive roller surface have virtually the same micro-hardness, is particularly suitable for a low-hardness roller which undergoes large deformation.

The micro-hardness $Hs_2$ of the conductive elastic layer after removal of the surface-treated layer may be determined at a polished surface of the conductive roller.

Preferably, the absolute value $|\Delta\mu|$ of the difference ($\Delta\mu=\mu_1-\mu_2$) between friction coefficient $\mu_1$ of the surface of the conductive roller and friction coefficient $\mu_2$ of the conductive elastic layer after removal of the surface-treated layer is 30% or less of the friction coefficient $\mu_2$. The surface-treated layer is integrally formed with the conductive roller such that the density gradually decreases from the surface to the inside of the conductive roller. Thus, similar to the case of hardness, friction coefficient $\mu_1$ of the surface of the conductive roller and friction coefficient $\mu_2$ of the conductive elastic layer are virtually equal to each other. In other words, according to the conductive roller of the present invention, friction coefficient $\mu_1$ of the conductive roller surface can be adjusted to a predetermined value by modifying friction coefficient $\mu_2$ of the conductive elastic layer to a predetermined value. When the absolute value $|\Delta\mu|$ ($\Delta\mu=\mu_1-\mu_2$) with respect to the friction coefficient $\mu_2$ of the conductive elastic layer is 30% or less, friction coefficient of the conductive roller after surface treatment can be maintained at a desired value. Thus, when the conductive roller is employed as a development roller, image failure induced by fog (hereinafter referred to as fogging) can be prevented. Particularly, the effect can be attained under HH (high temperature high-humidity) circumstances (30° C., 85%), where a roller of low friction coefficient causes image failure. As used herein, the term "fogging" refers to a phenomenon that a toner is deposited on an area on a photoreceptor drum other than a latent electrostatic image, thereby staining the background of a paper sheet with unnecessary toner images such as black spots.

In order to produce a conductive roller surface having the aforementioned micro-hardness $Hs_1$ and friction coefficient $\mu_1$, the surface-treatment liquid for forming a surface-treated layer is modified in accordance with needs.

Between the metallic core and the conductive elastic layer, an optional layer may be inserted. The optional layer may be formed from a foamed material such as nitrile rubber foam, particularly middle-to-high nitrile rubber foam or high-nitrile rubber foam. In order to attain satisfactory conductivity required to a charge-imparting roller, a sufficient amount of conductivity-imparting agent is required to be added to the foamed material layer. However, addition of the charge-imparting agent elevates the hardness of the layer, thereby failing to ensure a sufficient nip. When a large amount of plasticizer is added so as to lower hardness, the plasticizer migrates to the outer surface of the charge-imparting roller, thereby staining the photoreceptor which abuts the roller. In addition, the plasticizer impedes foaming of the rubber material, thereby failing to attain low hardness. Thus, a nitrile rubber foam, which has low gas permeability and is highly expandable by foaming, is preferably selected. In the foamed material layer, foam cells may be closed cells or open cells.

EXAMPLES

The present invention will next be described in detail by way of examples, which should not be construed as limiting the invention thereto. Unless otherwise specified, the unit "part(s)" is mass basis.

Example 1

<Production of Roller>

Toka Black #5500 (product of Tokai Carbon Co., Ltd.) (4 parts) and VALCAN XC (product of Cabot Corp.) (3 parts) were added to 3-functional polyether polyol (GP-3000, product of Sanyo Chemical Industries, Ltd.) (100 parts), and carbon particles were dispersed to a particle size of about 20 μm or less, followed by maintaining at 80° C., defoaming, and dehydrating, to thereby prepare liquid A. Separately, Coronate C-HX (product of Nippon Polyurethane Industry Co., Ltd.) (11 parts) was added to a prepolymer (Adiprene L100, product of Uniroyal) (25 parts), and the mixture was maintained at 80° C., to thereby prepare liquid B. Liquids A and B were mixed, and a rubber roller having a surface micro-hardness of 55.4° was produced from the mixture. The surface of the conductive roller was polished to a predetermined outer diameter, to thereby provide a conductive roller (untreated conductive roller 1).

<Preparation of Surface-treatment Liquid>

Ethyl acetate (85 parts) and an ether-based, isocyanate-end prepolymer (Adiprene L100, number average molecular weight of about 2,000, product of Uniroyal) (15 parts) were mixed to dissolve the prepolymer, to thereby prepare a surface-treatment liquid.

<Surface Treatment of Roller>

While the surface-treatment liquid was maintained at 25° C., the above roller was immersed in the liquid for 30 seconds. After immersion, the roller was heated for one hour in an oven maintained at 120° C., to thereby form a surface-treated layer. The roller was employed as a conductive roller of Example 1.

Example 2

The procedure of Example 1 was repeated, except that the untreated conductive roller was immersed for 15 seconds in a surface-treatment liquid prepared by dissolving an isocyanate-end compound (MR-400, number average molecular weight of <500, product of Nippon Polyurethane) (5 parts) in butyl acetate (95 parts), and the roller was drawn at half speed, to thereby produce a conductive roller of Example 2.

Example 3

The procedure of Example 1 was repeated, except that a surface-treatment liquid prepared by dissolving an ester-based, isocyanate-end prepolymer having a number average molecular weight of about 2,000 (VIBRATHANE 8585, product of Uniroyal) (15 parts) in butyl acetate (85 parts) was employed, to thereby produce a conductive roller of Example 3.

Comparative Example 1

The procedure of Example 1 was repeated, except that an isocyanate-end compound (MR-400, number average molecular weight of <500, product of Nippon Polyurethane) was used instead of the ether-based, isocyanate-end prepolymer (Adiprene L100, number average molecular weight of about 2,000, product of Uniroyal), to thereby produce a conductive roller of Comparative Example 1.

Comparative Example 2

<Production of Roller>

Coronate C-HX (product of Nippon Polyurethane Industry Co., Ltd.) (9.9 parts) was added to a prepolymer (Adiprene L100, product of Uniroyal) (22.5 parts), and the mixture was maintained at 80° C., to thereby prepare liquid C. Liquid A prepared in a manner similar to that of Example 1 and liquid C were mixed, and a rubber roller having a surface micro-hardness of 50.0° was produced from the mixture. The conductive roller was employed as an untreated conductive roller 2.

<Preparation of Surface-treatment Liquid>

Ethyl acetate (90 parts) and an isocyanate-end compound (MR-400, number average molecular weight of <500, product of Nippon Polyurethane) (10 parts) were mixed to dissolve the compound, to thereby prepare a surface-treatment liquid.

<Surface Treatment of Roller>

While the surface-treatment liquid was maintained at 25° C., the above roller was immersed in the liquid for 15 seconds. After immersion, the roller was heated for one hour in an oven maintained at 120° C., to thereby form a surface-treated layer. The roller was employed as a conductive roller of Comparative Example 2.

Comparative Example 3

The procedure of Example 3 was repeated, except that ethyl acetate was used instead of butyl acetate, to thereby produce a conductive roller of Comparative Example 3.

Comparative Example 4

An urethane coating (NeoRez R-940, product of Kusumoto Chemicals, Ltd.) was applied to the surface of the untreated conductive roller 1 so as to form a coating layer, to thereby produce a conductive roller of Comparative Example 4.

Referential Example 1

The conductive roller of Example 1 was polished again in a polishing amount of 0.3 mm, to thereby produce a conductive roller of Referential Example 1.

Test Example 1

Rubber hardness (Hs) of each of the untreated conductive rollers and the conductive rollers of the Examples, the Comparative Examples, and Referential Example 1 was determined by means of a micro-hardness tester (F360A, product of Koubunshi Keiki Co., Ltd.). Difference in micro-hardness between each of the rollers (Examples and Comparative Examples) and a corresponding untreated roller (simulating the condition after removal of the surface-treated layer), and percent change (%) in micro-hardness of each of the rollers (Examples and Comparative Examples) with respect to 100%, which was the micro-hardness of a corresponding untreated roller. The results are shown in Tables 1 and 2.

Test Example 2

Figure 2:
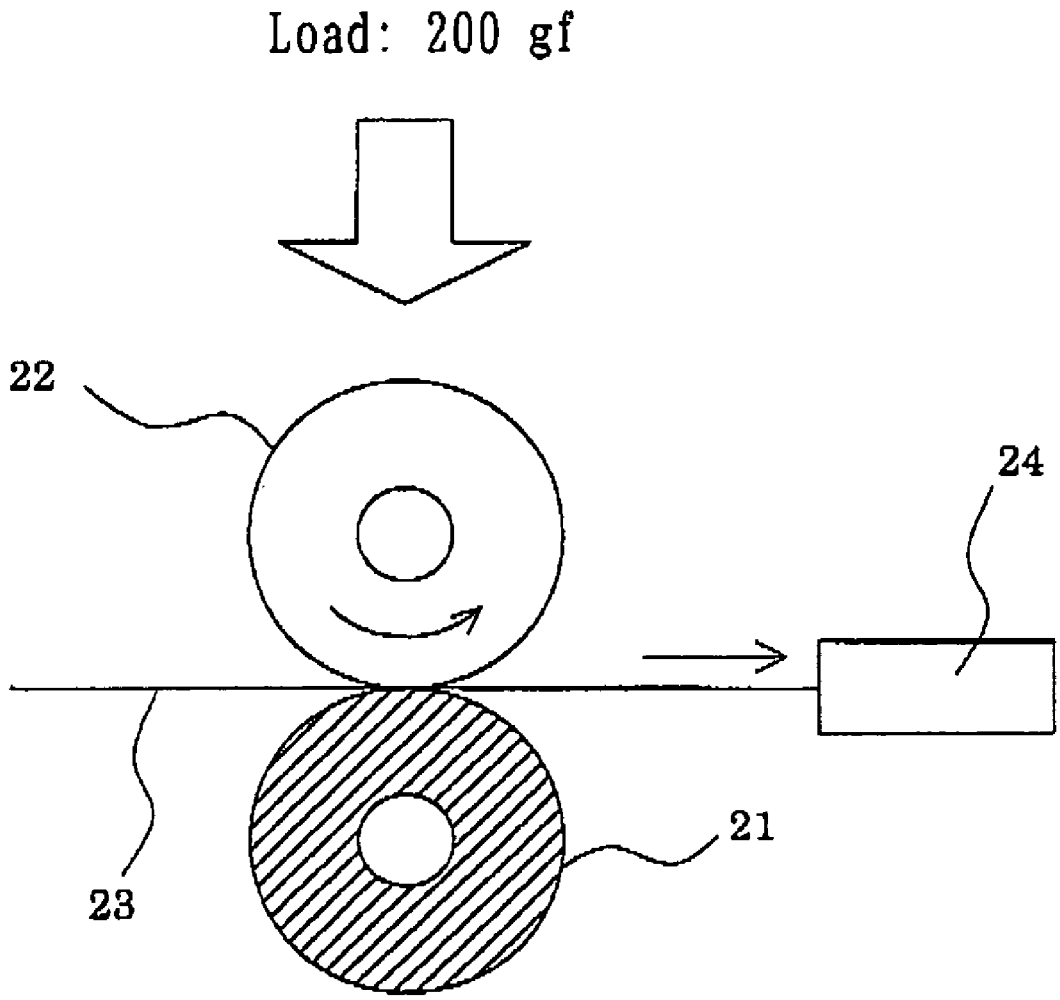
FIG. 2 schematically shows an apparatus for measuring friction coefficient carried out in Test Example 2.

Friction coefficient was determined for each of the untreated conductive rollers and the conductive rollers of the Examples, the Comparative Examples, and Referential Example 1. The friction coefficient (μ) was determined by means of an apparatus shown in FIG. 2. Specifically, a free roller 22 which was rotatably sustained was pressed against an affixed sample roller 21 at a load of 200 gf. A test sheet 23 inserted therebetween was drawn through rotation of the roller 21, and the load Q(N) applied to the sheet during drawing thereof was measured by means of a load cell 24 attached to one end of the sheet 23. The friction coefficient was calculated from the equation as shown hereinbelow. The paper sheet 23 (TYPE 6200; product of Ricoh Company, Ltd.) was conveyed at 50 mm/sec, and the measurement was carried out under ambient temperature/moisture conditions (NN: 23° C. and an RH of 55%). The results are shown in Tables 1 and 2.

$$\mu = Q(N)/(200\ \text{gf} \times 0.0098)$$

Difference in friction coefficient between each of the conductive rollers (Examples and Comparative Examples) and a corresponding untreated roller (simulating the condition after removal of the surface-treated layer) was calculated, along with percent change (%) in friction coefficient of each of the conductive rollers (Examples and Comparative Examples) with respect to 100%, which was the friction coefficient of the corresponding untreated roller (1 or 2). The results are shown in Tables 1 and 2.

Test Example 3

Electrical resistance of each of the conductive rollers of the Examples and the Comparative Examples was determined before use and after passage of 10,000 paper sheets in an actual machine (MICROLINE 9600PS, product of Oki Data). The resistance was determined through the following procedure. Specifically, a conductive roller was placed on an electrode member made of a SUS 304 sheet while a load of 500 g was applied to the metallic core. The resistance was measured by means of an ULTRA HIGH RESISTANCE METER (R8340A, product of Advantest) under ambient temperature/moisture conditions (NN; 23° C. and an RH of 55%). The results are shown in Tables 1 and 2.

Test Example 4

Image Evaluation

Each of the conductive rollers of the Examples and the Comparative Examples was operated in an actual machine (MICROLINE 9600PS, product of Oki Data). Images printed on a sheet were evaluated through visual observation in an initial operation stage and after passage of 10,000 sheets. The image condition was evaluated by the following ratings; O (excellent image), Δ (fair image), and X (unsatisfactory image). The results are shown in Tables 1 and 2.

Test Example 5

Fog Test

Each of the conductive rollers of the Examples and the Comparative Examples (1 to 3) was operated in an actual machine (MICROLINE 9600PS, product of Oki Data) under high temperature/moisture conditions (HH: 30° C. and an RH of 85%). The fogging state of the printed sheet obtained in an initial operation stage was evaluated through visual observation. The fogging state was evaluated by the following ratings: O (no fog), Δ(virtually no fog), and X (fogged). The results are shown in Tables 1 and 2.

TABLE 1

| | | | Untreated conductive roller 1 | Ex. 1 | Ex. 2 | Ex. 3 | Ref. Ex. 1 |
|---|---|---|---|---|---|---|---|
| Surface-treatment | Treatment liquid | Solvent | — | Ethyl acetate | Butyl acetate | Butyl acetate | — |
| | | Isocyanate compound (NCO) | — | Ether prepolymer | MDI compound | Ester prepolymer | — |
| | | NCO concentration (wt. %) | — | 15 | 5 | 15 | — |
| | Immersion time (sec) | | — | 30 | 15 | 30 | — |
| | Drawing speed (mm/min) | | — | 500 | 250 | 500 | — |
| Micro-hardness (°) | | | 55.4 | 57.0 | 58.0 | 57.8 | 55.6 |
| Difference in micro-hardness (to untreated conductive roller) ΔHs (°) | | | — | 1.6 | 2.6 | 2.4 | — |
| Percent change in micro-hardness (to untreated conductive roller) (%) | | | — | 2.9 | 4.7 | 4.3 | — |
| Friction coefficient μ | | | 3.4 | 2.8 | 2.9 | 2.5 | 3.6 |
| Difference in friction coefficient (to untreated conductive roller) Δμ | | | — | 0.6 | 0.5 | 0.9 | — |
| Percent change in friction coefficient (to untreated conductive roller) (%) | | | — | 17.6 | 14.7 | 26.5 | — |
| Initial resistivity (Ωcm) | | | — | $8.23 \times 10^5$ | $9.22 \times 10^6$ | $8.33 \times 10^5$ | — |
| Resistivity (after 10,000 sheets) (Ωcm) | | | — | $3.10 \times 10^6$ | $6.80 \times 10^6$ | $5.80 \times 10^6$ | — |
| Image quality | Initial | | — | ○ | ○ | ○ | — |
| | After 10,000 sheets | | — | ○ | Δ | ○ | — |
| Fogging | | | — | ○ | ○ | ○ | — |

TABLE 2

| | | | Untreated conductive roller 2 | Comp. Ex. 1 | Comp. Ex. 2 | Comp. Ex. 3 | Comp. Ex. 4 |
|---|---|---|---|---|---|---|---|
| Surface-treatment | Treatment liquid | Solvent | — | Ethyl acetate | Ethyl acetate | Ethyl acetate | Urethane coating |
| | | Isocyanate compound (NCO) | — | MDI compound | MDI compound | Ester prepolymer | |
| | | NCO concentration (wt. %) | — | 15 | 10 | 15 | |
| | Immersion time (sec) | | — | 30 | 15 | 30 | |
| | Drawing speed (mm/min) | | — | 500 | 500 | 500 | |
| Micro-hardness (°) | | | 50.0 | 59.0 | 55.0 | 58.3 | 57.3 |
| Difference in micro-hardness (to untreated conductive roller) ΔHs (°) | | | — | 3.6 | 5.0 | 2.9 | 1.9 |
| Percent change in micro-hardness (to untreated conductive roller) (%) | | | — | 6.5 | 10.0 | 5.2 | 3.4 |
| Friction coefficient μ | | | 4.7 | 1.6 | 2.0 | 2.6 | 2.2 |
| Difference in friction coefficient (to untreated conductive roller) Δμ | | | — | 1.8 | 2.7 | 0.8 | 1.2 |
| Percent change in friction coefficient (to untreated conductive roller) (%) | | | — | 52.9 | 57.4 | 23.5 | 35.3 |
| Initial resistivity (Ωcm) | | | — | $5.69 \times 10^5$ | $4.55 \times 10^5$ | $7.15 \times 10^5$ | $8.32 \times 10^5$ |
| Resistivity (after 10,000 sheets) (Ωcm) | | | — | $1.32 \times 10^9$ | $8.57 \times 10^8$ | $1.95 \times 10^7$ | $1.03 \times 10^7$ |

TABLE 2-continued

| | | Untreated conductive roller 2 | Comp. Ex. 1 | Comp. Ex. 2 | Comp. Ex. 3 | Comp. Ex. 4 |
|---|---|---|---|---|---|---|
| Image quality | Initial | — | Δ | Δ | Δ | Δ |
| | After 10,000 sheets | — | X | X | Δ | X Surface cracking |
| Fogging | | — | X | X | Δ | — |

The tests results will next be described. The conductive roller of Example 1, produced by use of a surface-treatment liquid containing an ether-based, isocyanate-end prepolymer having a number average molecular weight of about 2,000, exhibited a percent change in hardness of ≦5% (2.9%), a percent change in friction coefficient of ≦30% (17.6%), and stable resistivity. By virtue of these properties, the conductive roller ensured consistent image quality for a long period of time, and provided no fogged image under high temperature/moisture conditions (HH: 30° C. and an RH of 85%).

In contrast, the conductive roller of Comparative Example 4, which had been provided with a coating layer, exhibited a percent change in hardness of 3.4%, but generated cracks on the conductive roller surface after passage of 10,000 sheets and provided unsatisfactory printed images. The conductive roller of Comparative Example 1, produced from an isocyanate-end compound having a number average molecular weight of <500, exhibited a percent change in hardness of 6.5%, a percent change in friction coefficient of 52.9%, and considerably large variation in resistivity. Therefore, satisfactory printed images were obtained in an initial stage, but image failure occurred after long-term use.

Accordingly, the conductive roller of the present invention, having a surface-treated layer formed through impregnating a conductive elastic layer with a surface-treatment liquid and exhibiting a difference ΔHs ($Hs_1-Hs_2$) between micro-hardness $Hs_1$ of a surface of the conductive roller and micro-hardness $Hs_2$ of the conductive elastic layer after removal of surface-treated layer (untreated conductive roller) of 5% or less of the micro-hardness $HS_2$ had sufficient resilience in response to deformation, and exhibited small variation in electrical resistance. Thus, the conductive roller of the invention ensures consistent performance for a long period.

The conductive roller of Example 2, which had been produced by use of butyl acetate serving as a solvent, from an isocyanate-end compound having a number average molecular weight of <500, and through immersion for a shortened time, exhibited a percent change in hardness of ≦5% (4.7%), a percent change in friction coefficient of ≦30% (14.7%), and stable resistivity. By virtue of these properties, the conductive-roller ensured consistent image quality-for a long period of time, and provided no fogged image under high temperature/moisture conditions (HH: 30° C. and an RH of 85%).

In contrast, the conductive roller of Comparative Example 2, which had been produced with reducing hardness of the rubber roller and changing the amount of the isocyanate-end compound and through immersion for half the time, exhibited a percent change in hardness of 10.0%, a percent change in friction coefficient of 57.4%, and considerably large variation in resistivity. Therefore, satisfactory printed images were obtained in an initial stage, but image failure occurred after a long-term use.

Accordingly, even when the hardness of the surface-treated layer was reduced through decreasing the hardness of rubber roller and modifying the concentration of the surface-treatment liquid and the immersion time, sufficient surface characteristics of the roller could not be attained. However, a desired surface-treated layer could be obtained by preparing a surface-treatment liquid preventing permeation of the surface-treatment liquid into the conductive elastic layer.

The conductive roller of Example 3, which had been produced by use of a surface-treatment liquid containing butyl acetate and an ester-based, isocyanate-end prepolymer having a number average molecular weight of about 2,000, exhibited a percent change in hardness of ≦5% (4.3%), a percent change in friction coefficient of ≦30% (26.5%), and stable resistivity. By virtue of these properties, the conductive roller ensured consistent image quality for a long period of time, and provided no fogged image under high temperature/moisture conditions (HH: 30° C. and an RH of 85%).

In contrast, the conductive roller of Comparative Example 3, produced by use of ethyl acetate serving as a solvent, exhibited a percent change in hardness of 5.2% and considerably large variation in resistivity. No-fogged images could be obtained after passage of 10,000 sheets, but the image quality was unsatisfactory.

Accordingly, desired surface characteristics could be obtained by preparing, through changing the solvent, a surface-treatment liquid preventing permeation into the surface-treatment liquid to the conductive elastic layer.

The conductive roller of Referential Example 1, produced through re-polishing the conductive roller of Example 1 in a polishing amount of 0.3 mm, exhibited a rubber hardness and a friction coefficient almost equivalent to those of the untreated conductive roller 1. Thus, the untreated conductive roller and the conductive elastic layer after removal of the surface-treated layer through polishing were found to exhibit the same properties. In the Examples, percent change in hardness and that in friction coefficient were determined by use of untreated conductive rollers. Thus, instead of the conductive elastic layer after removal of the surface-treated layer, surface properties may be evaluated by use of the untreated conductive roller.

What is claimed is:

1. A conductive roller having a conductive elastic layer to which conductivity has been imparted by carbon black, and a surface-treated layer formed through impregnating a surface of the conductive elastic layer with a surface-treatment liquid, wherein the surface-treatment liquid contains an organic solvent and an isocyanate component, and the difference ΔHs defined as $Hs_1$ micro-hardness $Hs_1$ of a surface of the conductive roller and micro-hardness $Hs_2$ of the conductive elastic layer after removal of the surface-treated layer, the hardness being determined by means of a micro-hardness tester, is 5% or less of the micro-hardness $Hs_2$.

2. The conductive roller as described in claim 1, wherein an absolute value $|\Delta\mu|$ of the difference ($\Delta\mu=\mu_1-\mu_2$) between friction coefficient $\mu_1$ of the surface of the conductive roller and friction coefficient $\mu_2$ of the conductive elastic layer after removal of the surface-treated layer is 30% or less of the friction coefficient $\mu_2$.

3. The conductive roller as described in claim 1, wherein the organic solvent is selected from butyl acetate, pentyl acetate, N-pyrrolidone, and dimethyl sulfoxide.

4. The conductive roller as described in claim 1, wherein the isocyanate component is an isocyanate-end prepolymer having a number average molecular weight (Mn) of 500 to 5,000.

5. The conductive roller as described in claim 1, wherein the organic solvent is selected from butyl acetate, pentyl acetate, N-pyrrolidone, and dimethyl sulfoxide and the isocyanate component is an isocyanate-end prepolymer having a number average molecular weight (Mn) of 500 to 5,000.

* * * * *